US005857357A

United States Patent [19]

Bonaquist et al.

[11] Patent Number: 5,857,357

[45] Date of Patent: Jan. 12, 1999

[54] COLUMN CONFIGURATION AND METHOD FOR ARGON PRODUCTION

[75] Inventors: Dante Patrick Bonaquist; Michael James Lockett, both of Grand Island, N.Y.

[73] Assignee: Praxair Technology, Inc., Danbury, Conn.

[21] Appl. No.: 897,008

[22] Filed: Jul. 18, 1997

[51] Int. Cl.[6] ..... F25J 1/00

[52] U.S. Cl. ..... 62/643; 62/906; 62/924

[58] Field of Search ..... 62/643, 906, 924

[56] References Cited

U.S. PATENT DOCUMENTS

| | | | |
|---|---|---|---|
| 4,296,050 | 10/1981 | Meier | 261/112 |
| 4,499,035 | 2/1985 | Kirkpatrick et al. | 261/114 |
| 4,813,988 | 3/1989 | Bennett et al. | 62/906 |
| 4,836,836 | 6/1989 | Bennett et al. | 62/906 |
| 5,133,790 | 7/1992 | Bianchi et al. | 62/22 |
| 5,237,823 | 8/1993 | Cheung et al. | 62/906 |

FOREIGN PATENT DOCUMENTS

| | | |
|---|---|---|
| 1048936 | 8/1957 | Germany . |

*Primary Examiner*—Ronald Capossela
*Attorney, Agent, or Firm*—Stanley Ktorides

[57] ABSTRACT

A system for achieving a low level of nitrogen in a lower pressure column in the feed to the argon column in a cryogenic air separation system by use of two beds of structured packing of about equal height in the lower pressure column, with mixing and redistribution of liquid between them. The packed beds are located between the feed from the argon column top condenser and the point where the argon column feed is withdrawn.

10 Claims, 3 Drawing Sheets

COLUMN CONFIGURATION AND METHOD FOR ARGON PRODUCTION

FIELD OF THE INVENTION

This invention relates to the production of argon and, more particularly, to a low pressure column configuration of a cryogenic air separation system which provides an argon-rich feed that is substantially nitrogen free to an argon distillation column.

BACKGROUND OF THE ART

Argon is used in the metallurgical industry, particularly in argon-oxygen degassing of stainless and specialty steels and in the cutting and welding of various metals. Plasma jet torches, utilizing an argon mixture heated to temperatures in excess of 10,000 degrees K, are used for cutting operations and for coating metals with refractory materials. More recently argon has become an important ingredient in the electronics industry as a carrier, purge, or blanketing gas to exclude air from certain fabrication processes, especially in the growing of crystals, ion milling, and other etching processes.

The production of argon is an important economic factor in the industrial gas industry. Generally argon is a by-product of cryogenic air separation. However, a number of additional processing steps are necessary to produce a required purity of argon. One of the critical purity requirements is the concentration of contained nitrogen. Many applications of argon demand that it be essentially free of nitrogen.

The use of structured packing in cryogenic distillation columns has presented an opportunity to take advantage of the packing's characteristics of good mass transfer accompanied by low pressure drop (e.g., see U.S. Pat. No. 4,296,050 to Meier). The addition of a large number of theoretical trays in the low pressure column of a cryogenic air separation plant, without incurring the effects of an accompanying large pressure drop, by the use of structured packing presents a significant economic improvement in the production of argon.

In the past, the production of high purity argon involved a number of processing steps to produce a crude argon stream which was then upgraded in a refinery. Argon processing starts with the low pressure column of a cryogenic air separation plant. A low grade argon stream is withdrawn from an intermediate point in the low pressure column. The low grade argon stream is then fed into an argon column where it is separated into an overhead crude argon stream containing about 97.5 percent argon and a bottom stream which is returned to the low pressure column. The overhead stream also typically contains about 1.5 percent oxygen and about 1.0 percent nitrogen.

The crude argon stream from the top of the argon column is then warmed to about ambient temperature, at which time hydrogen is added and the mixture compressed and sent to a Deoxo catalytic furnace where the oxygen is removed. The combusted argon is cooled, dried and then further cooled to essentially liquefaction temperature. The cold argon stream is then sent to the refinery column where the excess hydrogen and remaining nitrogen are removed. Normal production provides an argon product stream containing less than 5 ppm nitrogen or oxygen.

German Patent 1 048 936, describes a means for reducing the nitrogen content of the feed to an argon column. The suggested process increases the number of trays used in the section of the low pressure column, between a feed from the argon condenser and the point where the argon column feed is withdrawn. The use of additional trays in the low pressure column, for the purpose of reducing the nitrogen content of the feed to the argon column, imposes a pressure drop penalty which increases the air compressor discharge pressure and therefore the energy requirements. Further, the increase in pressure level reduces relative volatility within the columns, resulting in a lowering of argon recovery.

In U.S. Pat. No. 5,133,790, Jul. 28, 1992, to Bianchi et al., (the disclosure of which is incorporated herein by reference), the use of structured packing is suggested to increase the number of equilibrium stages in the low pressure column between the feed from the argon condenser and the point where the argon column feed is withdrawn. The additional rectification in the lower pressure column is provided by the incorporation of structured packing rather than by trays. This reduces the nitrogen concentration substantially while maintaining the argon concentration at or near its maximum, enabling the production of nitrogen-free argon directly. The use of structured packing, rather than trays, avoids the energy penalty and reduced argon recovery.

Full scale testing of the system proposed by Bianchi et al., (which utilizes structured packing throughout the low pressure column), revealed that it is difficult to achieve low nitrogen levels in the argon column feed. Attempts were made to achieve low nitrogen levels using a single bed of packing between the feed from the argon condenser and the point where the argon column feed is withdrawn. The performance was not satisfactory.

It is an object of this invention to provide an improved argon production system which employs a low pressure distillation column with structured packing.

It is another object of this invention to provide an improved argon production system wherein the feed from a low pressure column to an argon column is largely nitrogen free.

SUMMARY OF THE INVENTION

To produce an argon product with a low level of included nitrogen (typically 10 ppm), a low level of nitrogen must be achieved in a section of the low pressure column for the feed to the argon column of a cryogenic air separation system. This is accomplished by use of two beds of structured packing of about equal height in the low pressure column, with mixing and redistribution of liquid between them. The packed beds are located in the column section between the feed from the argon column condenser and the point where the argon column feed is withdrawn.

DETAILED DESCRIPTION OF A PREFERRED EMBODIMENT

Figure 1:
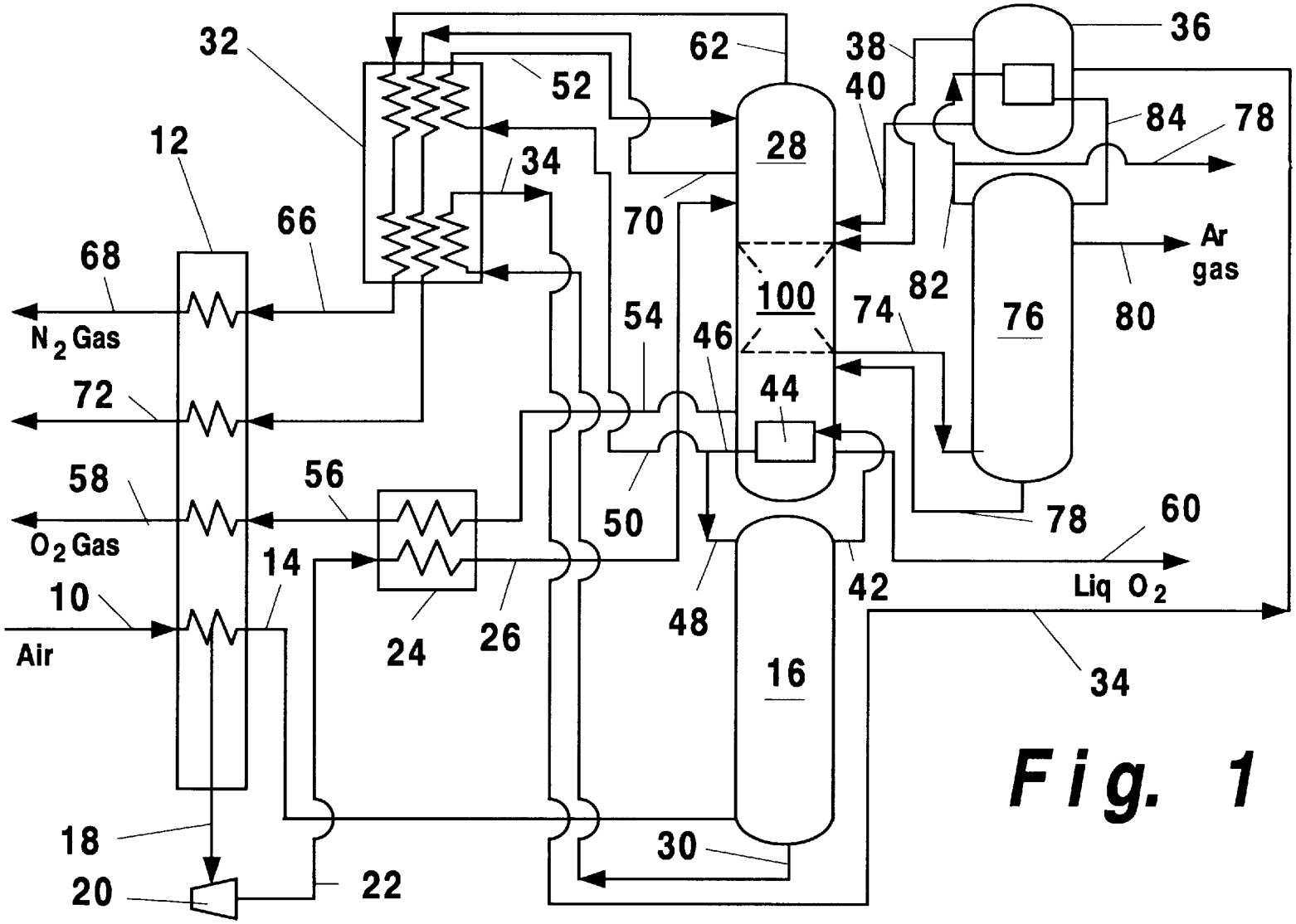
FIG. 1. is a schematic flow diagram of an argon production facility which is adapted to incorporate the invention.

Prior to describing the invention, it is worthwhile to define certain terms that are used in this specification and claims.

The term, "column", means a distillation or fractionation column or zone, ie., a contacting column or zone wherein liquid and vapor phases flow countercurrently to effect separation of a fluid mixture, as for example, by contacting of the vapor and liquid phases on a series of vertically spaced trays or plates mounted within the column and/or on packing elements. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al., page 13-3, The Continuous Distillation Process. The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures. Distillation is the separation process whereby heating of a liquid mixture can be used to concentrate the volatile component(s) in the vapor phase and the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and includes integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150° K.

The term "indirect heat exchange" means the bringing of two fluid streams into heat exchange relation without any physical contact or intermixing of the fluids with each other.

As used herein, the term "packing" means any solid or hollow body of predetermined configuration, size, and shape used as column internals to provide surface area for the liquid to allow mass transfer at the liquid-vapor interface during countercurrent flow of the two phases.

As used herein, the term "structured packing" means packing wherein individual members have specific orientation relative to each other and to the column axis.

As used herein the term "argon column system" means a system comprising a column and a top condenser which processes a feed comprising argon and produces a product having an argon concentration which exceeds that of the feed.

As used herein the term "top condenser" means a heat transfer device used to liquefy vapor rising from the top of the argon column.

As used herein the term "equilibrium stage" means a contact process between vapor and liquid such that the exiting vapor and liquid streams are in equilibrium.

The invention comprises, in general, a modification to a lower pressure column to provide, between the feed from an argon column top condenser and a point where argon column feed is withdrawn (i.e., generally at or somewhat below the point of maximum argon concentration), two beds of structured packing of about equal height, with mixing and redistribution of liquid between them. The modifications to the lower pressure column enhances the mass transfer performance of the structured packing which is the key to obtaining a desired low nitrogen level in the argon column feed. Optionally, to guard against the adverse effects of wall flow in the packed beds, one or more trays are positioned immediately above the point where the argon column feed is withdrawn.

Prior to describing, in further detail, the modifications to the lower pressure column, a description of the overall air distillation/argon production system will be presented.

Referring to FIG. 1, a cleaned compressed air feed is cooled by passage through heat exchanger 12 by indirect heat exchange with return streams, and the resulting cooled air stream 14 is passed into column 16 which is the higher pressure column of a double column system and is operating at a pressure generally within the range of from 70 to 95 pounds per square inch absolute (psia). A portion of the feed air stream 18 is passed through heat exchanger 24, wherein it serves to warm an outgoing oxygen product stream. The resulting air stream 26 is then passed into column 28 which is the lower pressure column of the double column system and is operating at a pressure less than that of the higher pressure column and generally within the range of from 15 to 25 psia.

Within column 16, the feed air is separated by cryogenic rectification into oxygen-enriched liquid and nitrogen-enriched vapor. Oxygen-enriched liquid is removed from column 16 as stream 30, passed partially through heat exchanger 32, and the resulting stream 34 is passed into argon column top condenser 36 wherein it is partially vaporized by indirect heat exchange with condensing argon column top vapor. The resulting gaseous and liquid oxygen-enriched fluid is passed from top condenser 36 as streams 38 and 40, respectively, into column 28.

Nitrogen-enriched vapor is removed from column 16 as stream 42 and is passed into reboiler 44 wherein it is condensed by indirect heat exchange with boiling column 28 bottoms. The resulting nitrogen-enriched liquid is divided into stream 48 which is returned to column 16 as reflux, and into stream 50 which is passed partially through heat exchanger 32 and then, as stream 52, is passed into column 28.

Within column 28 the various feeds into the column are separated by cryogenic rectification into refined nitrogen and oxygen. Gaseous oxygen is removed from column 28 as stream 54 from above reboiler 44. This stream is then passed through heat exchanger 24 and resulting stream 56 is passed through heat exchanger 12 and is then recovered as gaseous oxygen product stream 58. If desired, a liquid oxygen stream 60 may be removed from column 28 from the area of reboiler 44 and recovered as liquid oxygen product. The product oxygen will generally have an oxygen concentration of at least 99.0 percent.

Gaseous nitrogen is removed from column 28 as stream 62 and is warmed by passage through heat exchanger 32. The resulting stream 66 is further warmed by passage through heat exchanger 12 and is then recovered as gaseous nitrogen product stream 68 generally having an oxygen concentration less than 10 parts per million (ppm). A waste stream 70 is removed from column 28 below the product nitrogen withdrawal point, warmed by passage through heat exchangers 32 and 12, and removed from the system as stream 72. This waste stream serves to control product purity in the nitrogen and oxygen product streams.

An argon column feed 74 comprising at least 5 percent argon and preferably at least 7 percent argon, of less than 50 ppm nitrogen with the balance substantially oxygen is withdrawn from column 28 and passed into argon column 76, wherein it is separated by cryogenic rectification into oxygen-rich liquid and argon-rich vapor which is substantially nitrogen-free. By nitrogen-free it is meant having not more than 10 ppm nitrogen, preferably not more than 5 ppm nitrogen, most preferably not more than 2 ppm nitrogen. The oxygen-rich liquid is removed from column 76 and returned to column 28 as stream 78. Argon-rich vapor may be recovered directly from the argon column system as nitrogen-free product argon in stream 80. Nitrogen-free product argon may also be recovered as liquid. Further, column 76 may have sufficient separating stages so that the oxygen content of the argon product is low, i.e., less than 100 ppm $O_2$, or preferably less than 10 ppm $O_2$.

Some of the argon column vapor is passed as stream 82 out from column 16 and into top condenser 36, wherein it is condensed by indirect heat exchange against partially vaporizing oxygen-enriched liquid, as was previously described. Resulting liquid stream 84 is returned to column 76 as reflux. If desired, and dependent on the nitrogen content of argon column feed 74, a portion 79 of stream 82 may be removed as a waste argon stream. This serves to further reduce the nitrogen concentration in the product argon.

Figure 2:
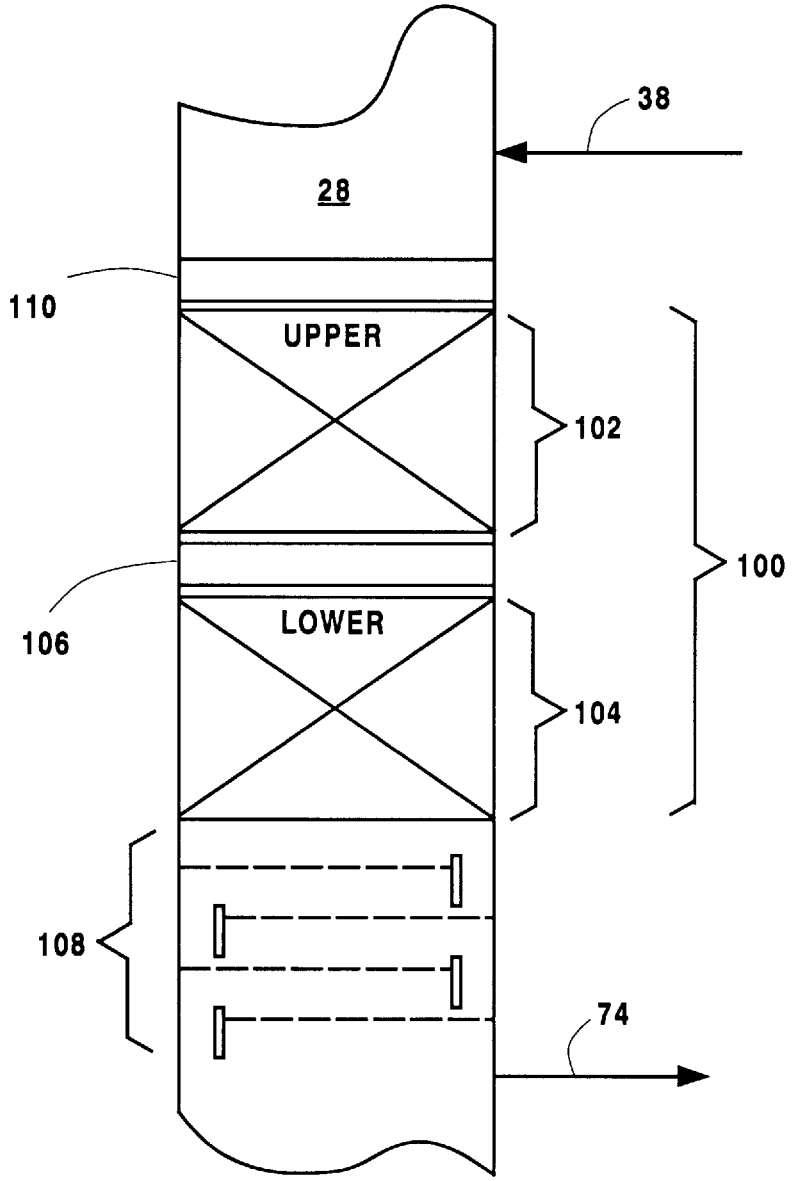
FIG. 2 is a schematic diagram of an embodiment of the invention, illustrating the arrangement of components in a low pressure column which enables a flow of an argon rich stream to the argon column with a very low level of included nitrogen.

To produce an argon product meeting a nitrogen inclusion specification, typically 10 ppm or less, a low level of nitrogen must be achieved in section 100 of lower pressure column 28, especially at the point where argon column feed stream 74 exits column 28. As shown in FIG. 2, such a low level of nitrogen is achieved by providing separate beds of structured packing sections 102 and 104, preferably of equal height, between argon column condenser vapor feed 38 and the withdrawal point of argon column feed stream 74. Further, a liquid collection and distribution device 106 is positioned at the midpoint between structured packing sections 102 and 104 to effect a redistribution of liquid at the midpoint.

As will be understood from the discussion below, mixing and redistribution of the liquid is key to obtaining the desired low level of nitrogen in the argon column feed. Such mixing can be additionally enhanced by placement of one or more trays 108 at the bottom of lower structured packing section 104. The optional use of the trays 108 serves to mitigate the adverse effects of any column wall flow in the packing bed 104. The trays serve to mix all the downflowing liquid and avoid the undesirable effects of the liquid bypass that would be the result of column wall flow. Feed stream 74 to argon column 76 is then withdrawn from the bottom of this tray section.

It should be noted that column section 100 is defined by the upper feedpoint 38 which is the enriched argon vapor from argon column condenser 38 and the lower draw 74 which is the vapor feed to argon column 76. The enriched oxygen liquid 40 from argon column 76 is typically added to low pressure column 28 at a point above oxygen enriched vapor stream 38, but in some circumstances it is added at the same level. Further, in some situations, a fraction of oxygen enriched liquid stream 34 may be added directly to the low pressure column without traverse of the argon column condenser. Again, that liquid would typically be added at a level above oxygen enriched vapor stream 38.

The separation performance of structured packing distillation column sections operating close to an equilibrium pinch is adversely affected by any liquid maldistribution. It has been determined that the sensitivity of the performance of a given column section to a certain level of liquid maldistribution can be reduced by mixing of the liquid descending in the column at some point intermediate in the section. The use of trays at the bottom of a single bed of packing in a column section which contains a pinch between the operating line and the equilibrium line has the overall effect of eliminating the sensitivity to the pinch, thus improving the performance of that section. The performance improvement is due to the mixing of liquid descending from the packed bed. The mixing eliminates local pinches that develop when liquid distribution deviates from plug flow.

Accordingly, liquid descending from above in lower pressure column 28 is received on liquid collection and distribution device 110 at the point where the vapor from argon column condenser 36 is admitted to low pressure column 28. The liquid is redistributed to upper structured packing section 102, enabling intimate and uniform contact between the descending liquid and rising vapor. However, because of physical imperfection of upper structured packing section 102, some maldistribution of the liquid takes place within the packing, along with some channeling of the liquid to the wall of column 28. By intercepting the liquid at the midpoint of section 100 with liquid collection and distribution device 106, the liquid maldistribution is corrected.

Lower structured packing section 104, of height about equal to the upper structured packing section 102, is used to provide the required amount of packing to reduce the nitrogen concentration to the desired level.

Figure 3:
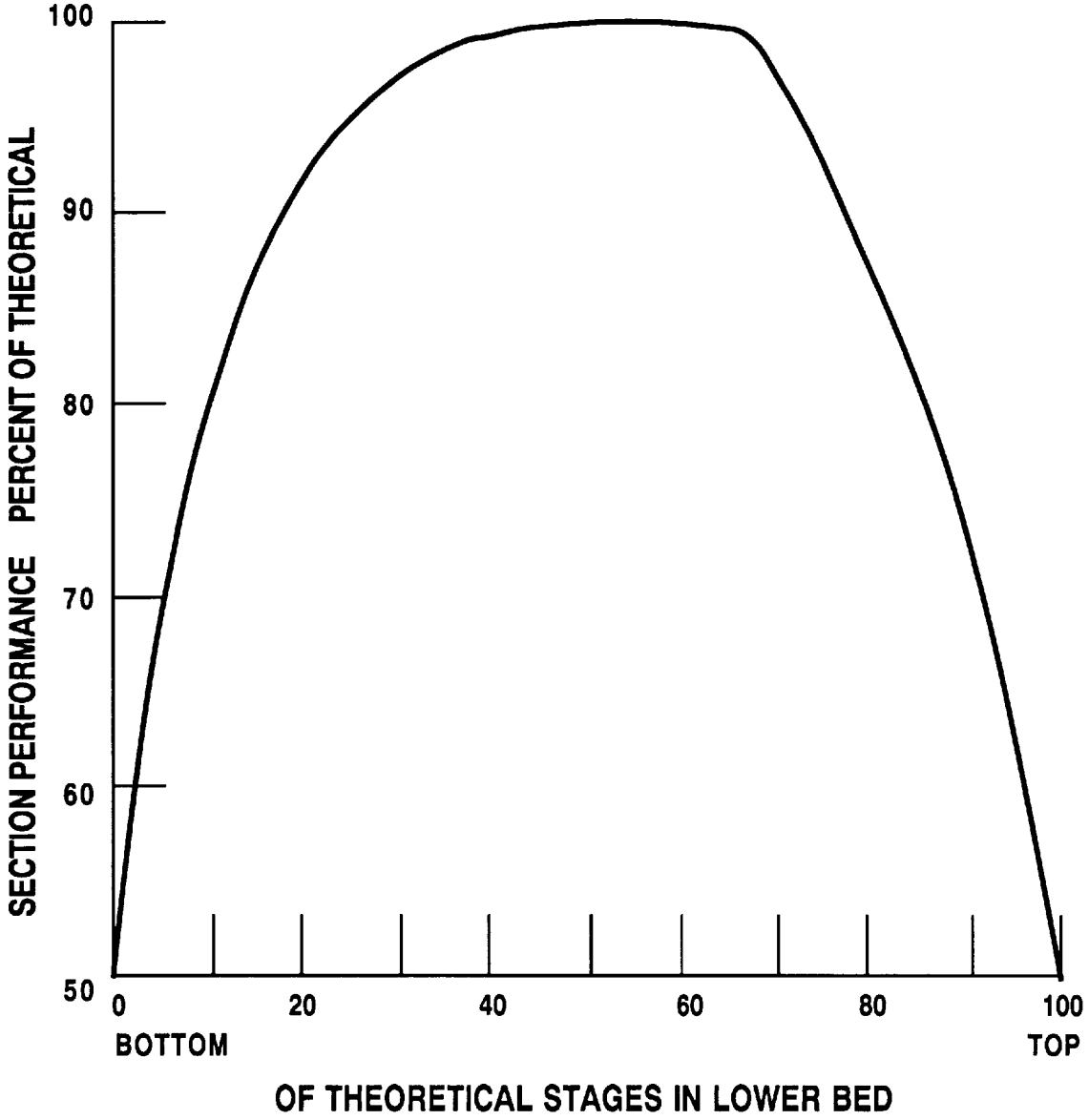
FIG. 3 is a plot of calculated column section performance versus a percentage of theoretical stages in a lower structured packing bed of a low pressure column used with the invention.

Satisfactory performance of the invention is dependent upon splitting section 100 of the lower pressure column 28 into two parts. The effect of a given maldistribution of the liquid in section 100 can be understood by referring to FIG. 3 which is based on mathematical modeling of the distillation system. FIG. 3 is a plot of section performance versus a percentage of theoretical stages in lower packing bed 104. The plot shows the effect of splitting packed section 100 into two parts and remixing and redistributing the liquid fed to the lower section.

As is seen from the plot, the rectification performance is quite poor if remixing of the liquid is carried out only at either of the two extremes, the top or bottom, of section 100. As the point of remixing is raised from the bottom of section 100, the effectiveness of the separation is improved until a level of about one-third of the number of theoretical stages is reached. At this level essentially complete theoretical separation performance is achieved for the total packed section. This high level of performance continues until a level of about two-thirds of the structured packing is reached, at which time the separation performance drops off. This demonstrates the desirability of splitting the structured packing section into two parts of essentially equal performance. However, it is not critical that they be exactly equal. A split of one-third to about two-thirds from the bottom will provide for nearly theoretical performance.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. A cryogenic gas distillation system incorporating a higher pressure column, a lower pressure column and an argon distillation column, said lower pressure column including (i) a feed point for receiving an oxygen-enriched stream from a heat exchanger associated with said argon column and (ii) an outlet point for providing a feed stream to said argon column, said lower pressure column further comprising:

a first structured packing bed and a second structured packing bed positioned between said feed point and said outlet point in said lower pressure column; and liquid collection and distribution means positioned between said first structured packing bed and said second structured packing bed, for redistributing liquid flow from said first structured packing bed before said liquid flow enters said second structured packing section.

2. The cryogenic gas distillation system as recited in claim 1, wherein said liquid collection and distribution means comprises a liquid collection and distribution tray.

3. The cryogenic gas distillation system as recited in claim 1, further comprising:

tray means for collecting and redistributing liquid, positioned between said second structured packing section and said outlet point.

4. The cryogenic gas distillation system as recited in claim 1, wherein said first structured packing bed and said second structured packing bed, together, comprise X theoretical stages, and wherein said second structured packing bed comprises from about one-third to about two-thirds of said X theoretical stages, with said first structured packing bed comprising a remainder of said X theoretical stages that are not comprised by said first structured packing bed.

5. The cryogenic gas distillation system as recited in claim 1, wherein said first structured packing bed and said second structured packing bed, together, comprise X theoretical stages, and wherein said first structured packing bed and second structured packing bed each comprise about one-half of said X theoretical stages.

6. The cryogenic gas distillation system as recited in claim 1, wherein said outlet point is positioned at a point of about maximum argon concentration in said lower pressure column.

7. A method for producing argon which is substantially nitrogen-free, said method performed by a cryogenic gas distillation system incorporating a higher pressure column, a lower pressure column and an argon distillation column, said lower pressure column including (i) a feed point for receiving an oxygen-enriched liquid from a heat exchanger associated with said argon column and (ii) an outlet point for providing a feed stream to said argon column, said method comprising the steps of:

providing countercurrent flows of process gases and said liquid through a first structured packing bed and a second structured packing bed that is positioned between said feed point and said outlet point in said lower pressure column; and collecting and distributing said liquid at a point between said first structured packing bed and said second structured packing bed, to enable a redistribution of liquid flow from said first structured packing bed before said liquid flow enters said second structured packing bed.

8. The method as recited in claim 7, further comprising the step of:

collecting and redistributing said liquid exiting from said second structured packing bed and before said liquid reaches said outlet point.

9. The method as recited in claim 7, wherein said first structured packing bed and said second structured packing bed, together, comprise X theoretical stages, and wherein said second structured packing bed comprises from about one-third to about two-thirds of said X theoretical stages, with said first structured packing bed comprising a remainder of said X theoretical stages that are not comprised by said first structured packing bed.

10. The method as recited in claim 7, wherein said first structured packing bed and said second structured packing bed, together, comprise X theoretical stages, and wherein said first structured packing bed and second structured packing bed each comprise about one-half of said X theoretical stages.

* * * * *